US008801364B2

(12) United States Patent
Morris et al.

(10) Patent No.: US 8,801,364 B2
(45) Date of Patent: Aug. 12, 2014

(54) IMPELLER BACKFACE SHROUD FOR USE WITH A GAS TURBINE ENGINE

(75) Inventors: Mark C. Morris, Phoenix, AZ (US); Alexander MirzaMoghadam, Phoenix, AZ (US); Khosro Molla Hosseini, Scottsdale, AZ (US); Kin Poon, Tempe, AZ (US); Jeff Howe, Chandler, AZ (US); Alan G. Tiltman, Fountain Hills, AZ (US)

(73) Assignee: Honeywell International Inc., Morristown, NJ (US)

( * ) Notice: Subject to any disclaimer, the term of this patent is extended or adjusted under 35 U.S.C. 154(b) by 1065 days.

(21) Appl. No.: 12/794,433

(22) Filed: Jun. 4, 2010

(65) Prior Publication Data

US 2011/0299972 A1 Dec. 8, 2011

(51) Int. Cl.
*F01D 3/00* (2006.01)

(52) U.S. Cl.
USPC ..... 415/106; 415/171.1

(58) Field of Classification Search
USPC ..... 415/104, 106, 110, 111, 170.1, 171.1, 415/173.1; 416/185, 186 R, 223 B, 236 R
See application file for complete search history.

(56) References Cited

U.S. PATENT DOCUMENTS

| | | | | |
|---|---|---|---|---|
| 3,565,543 | A * | 2/1971 | Mrazek | 415/106 |
| 6,276,896 | B1 * | 8/2001 | Burge et al. | 415/115 |
| 7,008,177 | B2 * | 3/2006 | Britt et al. | 415/111 |
| 7,338,251 | B2 * | 3/2008 | Ro et al. | 415/58.3 |
| 7,775,758 | B2 * | 8/2010 | Legare | 415/1 |
| 7,909,580 | B2 * | 3/2011 | Simpson et al. | 416/223 A |
| 2008/0080969 | A1 * | 4/2008 | Legare et al. | 415/170.1 |
| 2008/0193277 | A1 | 8/2008 | Legare | |

* cited by examiner

*Primary Examiner* — Ned Landrum
*Assistant Examiner* — Ryan Ellis
(74) *Attorney, Agent, or Firm* — Ingrassia Fisher & Lorenz, P.C.

(57) ABSTRACT

An impeller or axial stage compressor disk backface shroud for use with a gas turbine engine is disclosed. The backface shroud includes, but is not limited to, a substantially funnel shaped body having a surface. The substantially funnel shaped body is configured to be statically mounted to the gas turbine engine substantially coaxially with the impeller or axial stage compressor disk. The surface and a backface of the impeller or axial stage compressor disk form a cavity that guides an airflow portion to a turbine when the substantially funnel shaped body is mounted coaxially with the impeller or axial stage compressor disk and axially spaced apart therefrom. The airflow portion has a tangential velocity and a recessed groove in the surface of the backface shroud is oriented generally transversely to the tangential velocity to at least partially interfere with the airflow portion, thus affecting static pressure in the cavity.

18 Claims, 8 Drawing Sheets

IMPELLER BACKFACE SHROUD FOR USE WITH A GAS TURBINE ENGINE

TECHNICAL FIELD

The present invention generally relates to impeller backface shrouds and more particularly relates to impeller backface shrouds for use in gas turbine engines having impellers.

BACKGROUND

A thrust bearing is a component in a gas turbine engine that is designed to support other components of the gas turbine engine and to brace such other components against the thrust that they generate. One engine sub-assembly that is supported by a thrust bearing is commonly referred to as the spool. The spool includes a shaft, a compressor that may include an impeller or axial stages, and a turbine. The compressor and the turbine are mounted to the shaft and rotate together with the shaft. The compressor and the turbine each generate thrust that acts on the spool. The compressor generates thrust on the spool that pushes the spool towards the front of the engine while the turbine generates thrust that pushes the spool towards the rear of the engine. These oppositely directed thrusts are rarely, if ever equal. Consequently a net or resultant thrust acting in either the forward or rearward direction will be exerted on the spool as a result of the differing magnitudes of these oppositely directed forces (hereinafter, the "spool thrust"). The thrust bearing supports and braces the spool against the spool thrust to inhibit the spool from being displaced from its mounted position within the gas turbine engine.

Computational models are available that enable engine designers to estimate the direction and magnitude of the spool thrust that will be generated by a spool when designing and developing new gas turbine engines. These estimates are then used to design thrust bearings that will be sufficiently robust to support and brace the spool against the anticipated spool thrust. However, the computational models are not exact and it is often the case that the direction and/or the magnitude of the spool thrust of the spool, once built, differs from what was predicted by such models.

If the difference between the anticipated spool thrust and the actual spool thrust differs substantially, then the thrust bearing will be required to brace the spool against significantly more or significantly less spool thrust than it was designed to accommodate. If too much spool thrust is exerted on the thrust bearing, in either the forward or rearward direction, the ball bearings in the thrust bearing can damage their housing. If excessive spool thrust is continued for any length of time, the thrust bearing may fail. If too little spool thrust is exerted on the thrust bearing, then there will be an insufficient amount of friction acting on the ball bearings in the thrust bearing, causing them to skip and skid. This, in turn, may also damage their housing and may also lead to failure of the thrust bearing.

When the actual spool thrust differs substantially from the anticipated spool thrust, the conventional solution has been to redesign the thrust bearings to accommodate the actual spool thrust. Although this solution is adequate, the amount of time needed to design, develop and manufacture new thrust bearings is quite substantial. Thus, this solution can delay engine development by months or years which, in turn, can cost the engine developer millions of dollars.

BRIEF SUMMARY

Although, the present invention describes an impeller backface shroud for use with a gas turbine engine having an impeller, the embodiment may also comprise the compressor disk-shroud spacing behind the last stage of an axial compressor as well. Gas turbine engines that employ such impeller or compressor disk backface shrouds, and methods of using such impeller or compressor disk backface shrouds are disclosed herein.

In an embodiment, the impeller backface shroud includes, but is not limited to a substantially funnel shaped body having a surface. The substantially funnel shaped body is configured to be statically mounted to the gas turbine engine in a position that is substantially coaxial with the impeller. The surface and a backface of the impeller forming a cavity that is configured to guide an airflow portion from the impeller to a turbine when the substantially funnel shaped body is mounted to the gas turbine engine coaxially with the impeller and axially spaced apart therefrom in an aft direction. A recessed groove is defined in the surface. The airflow portion has a tangential velocity and the recessed groove is oriented generally transversely to the tangential velocity of the airflow portion and is configured to at least partially interfere with the airflow portion, whereby a static pressure in the cavity is affected.

In another embodiment, the gas turbine engine includes, but is not limited to a shaft, an impeller affixed to the shaft, a turbine affixed to the shaft at a location aft of the impeller, and an impeller backface shroud. The impeller backface shroud includes, but is not limited to, a substantially funnel shaped body having a surface. The substantially funnel shaped body is statically mounted to the gas turbine engine in a position that is substantially coaxial with the impeller and axially spaced apart therefrom in an aft direction. The surface and a backface of the impeller form a cavity. The cavity is configured to guide an airflow portion from the impeller to the turbine. The airflow portion has a tangential velocity. A recessed groove is defined in the surface. The recessed groove is oriented generally transversely to the tangential velocity of the airflow portion and is configured to at least partially interfere with the airflow portion, whereby a static pressure in the cavity is affected.

In another embodiment, a method for compensating for an undesirable amount of spool thrust in a gas turbine engine is disclosed. The gas turbine engine has a shaft, an impeller affixed to the shaft, a turbine affixed to the shaft at a location aft of the impeller, and an impeller backface shroud statically mounted to the gas turbine engine in a position that is coaxial with the impeller and aft thereof such that a surface of the impeller backface shroud and a backface of the impeller form a cavity configured to guide an airflow portion from the impeller to the turbine. The airflow portion has a tangential velocity. The method includes, but is not limited to, the steps of (A) determining a target static pressure, (B) performing a computational fluid dynamic analysis using a processor to determine a static pressure in the cavity that would result from defining a recessed groove in the surface of the backface shroud, the recessed groove having a predetermined configuration, (C) changing the predetermined configuration of the recessed groove if the static pressure in the cavity differs substantially from a target static pressure, (D) repeating steps B and C until a predetermined configuration of the recessed groove that yields a static pressure in the cavity that does not differ substantially from the target static pressure is determined, (E) manufacturing a second impeller backface shroud including a recessed groove having the predetermined configuration determined at step D, and (F) assembling the second impeller backface shroud to the gas turbine engine.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background or the following detailed description.

Figure 1:
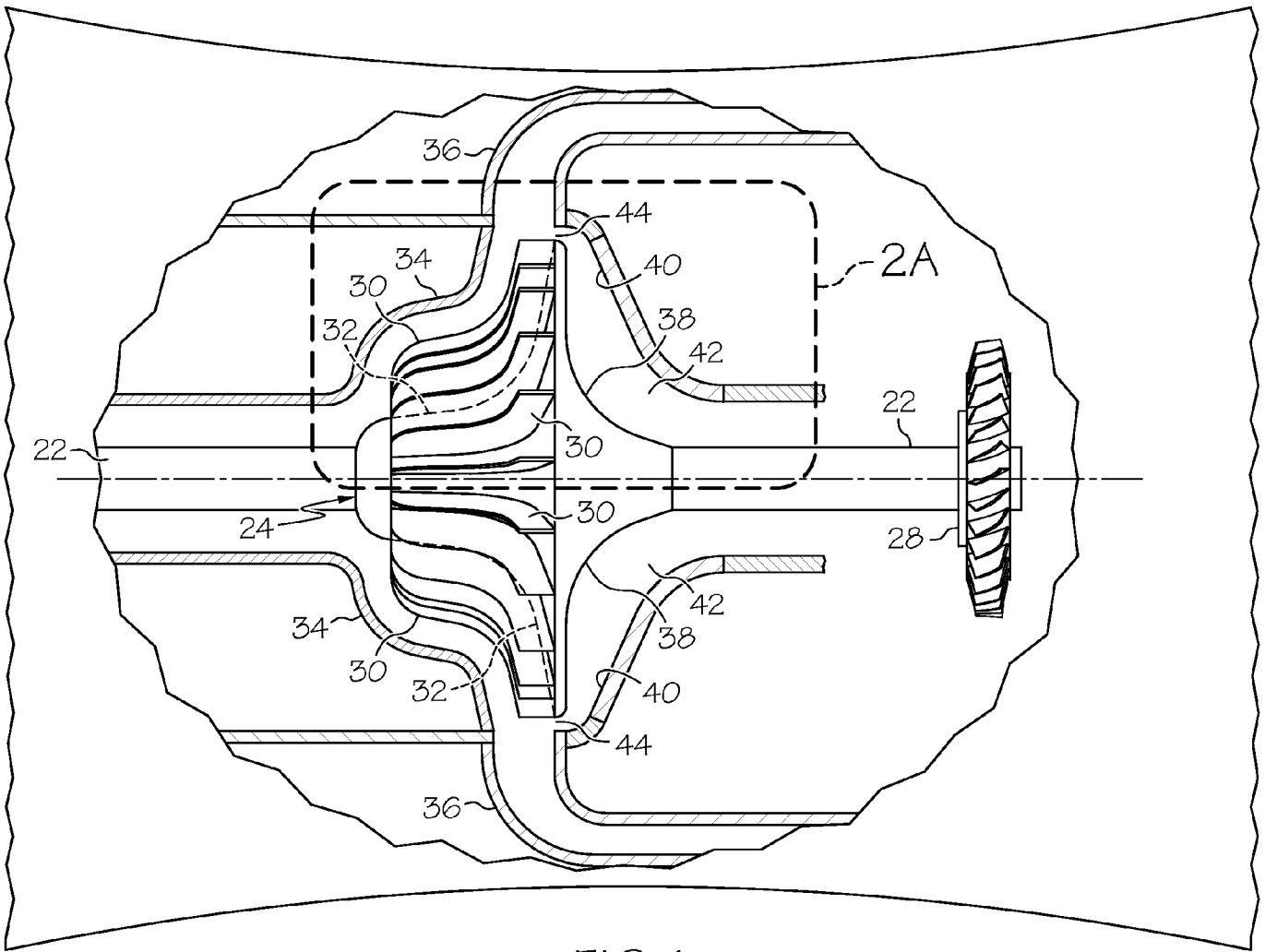
FIG. 1 is a simplified fragmentary cutaway view of a gas turbine engine illustrating a shaft, an impeller, an impeller backface shroud, and a turbine.

FIG. 1 is a simplified fragmentary cutaway view of a gas turbine engine 20 illustrating a shaft 22, an impeller 24, an impeller backface shroud 40, and a turbine 28. Shaft 22, impeller 24 and turbine 28 rotate about a longitudinal axis indicated by the broken line running through the center of shaft 22. The rotation of these components (as well as others) causes air to flow (hereinafter, the "airflow") through gas turbine engine 20 from an inlet (not shown) at a forward portion of gas turbine engine 20 to an exhaust port (not shown) at a rear portion of gas turbine engine 20. As the airflow moves through gas turbine engine 20, it is first compressed in a compressor and then heated in a combustion chamber together with fuel causing its volume to rapidly expand, at which point it is exhausted out of the exhaust port.

Impeller 24 contributes to the movement of the airflow through gas turbine engine 20. Impeller 24 takes airflow that is moving in an axial direction and spins it rapidly, which together with the contour of impeller 24, changes the direction of the airflow's movement from axial to radial. Impeller 24 includes multiple impeller fins 30 extending longitudinally along an impeller surface 32 and which are oriented generally transversely to impeller surface 32. Impeller fins 30 are configured and contoured to receive the axially flowing airflow and to redirect it so that it flows in a radial direction.

An impeller shroud 34 is statically mounted (i.e., it does not rotate together with shaft 22) to an internal portion of gas turbine engine 20. Impeller shroud 34 is positioned in a closely spaced apart relationship with an outer periphery of impeller fins 30. This closely spaced apart relationship inhibits air from bleeding off of the periphery of impeller fins 30 as impeller 24 rotates. In this manner, impeller shroud 34 cooperates with impeller 24 to confine the airflow to a path bounded on one side by impeller surface 32 and bounded on the other side, by impeller shroud 34. While a gap is illustrated between impeller fins 30 and impeller shroud 34, it should be understood that the gap is exaggerated to assist the viewer in comprehending where impeller shroud 34 ends and where impeller fins 30 begin.

Conduits 36 are statically mounted to an internal portion of gas turbine engine 20 and are positioned to receive the airflow as it exits impeller 24. Conduits 36 convey the airflow from impeller 24 to turbine 28.

An impeller backface 38 is located at a rear portion of impeller 24 and rotates together with impeller 24. Impeller backface 38 extends radially inwardly from a periphery of impeller 24 towards shaft 22. Impeller backface 38 comprises a generally smooth surface having a gentle, curved contour that is substantially radially oriented at its axially forward end and that is substantially axially oriented at its axially rear end.

An impeller backface shroud 40 is statically mounted to an internal portion of gas turbine engine 20 and therefore does not rotate with shaft 22. Impeller backface shroud 40 may be mounted to gas turbine engine 20 by any suitable means including, but not limited to, the use of fasteners or welds. Impeller backface shroud 40 is a generally funnel shaped component that is axially spaced apart from impeller backface 38. Impeller backface 38 and impeller backface shroud 40 form a cavity 42. A gap 44 between the periphery of impeller 24 and conduits 36 permits a portion of the airflow to be redirected into cavity 42. This redirected portion of the airflow is used to cool turbine 28.

Figure 2A:
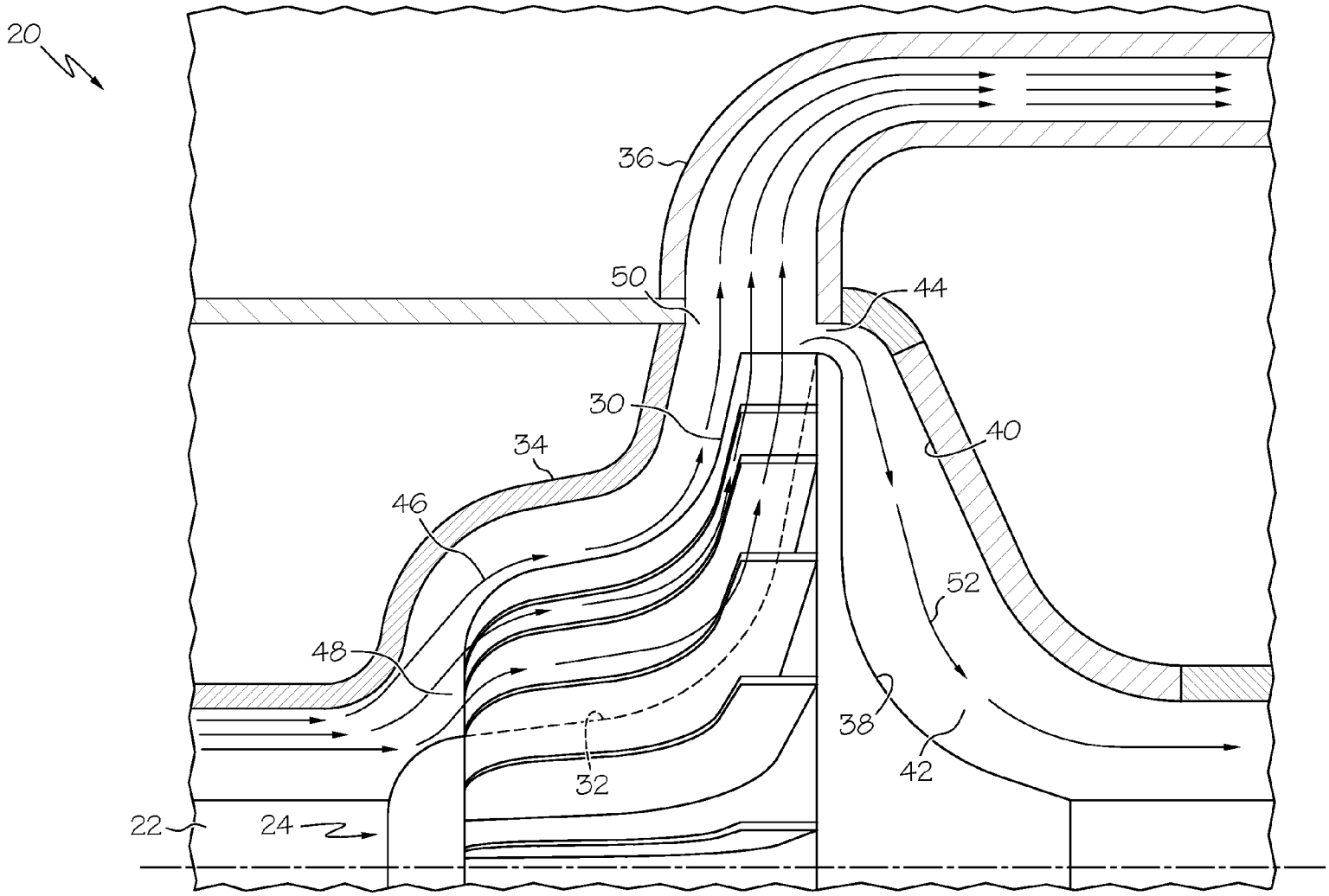
FIG. 2A is an expanded view of a portion of the gas turbine engine of FIG. 1.

FIG. 2A is an expanded view of a portion of gas turbine engine 20 of FIG. 1. For ease of illustration, only the portion located within the dotted line identified by the reference numeral 2A of FIG. 1 has been illustrated. In this figure, airflow 46 is illustrated moving through gas turbine engine 20. Airflow 46 enters impeller 24 at impeller inlet 48 moving in an axial direction. Once airflow 46 enters impeller 24, it is spun by impeller 24 about shaft 22. The spinning of impeller 24 causes airflow 46 to develop a tangential velocity and to begin moving in a circular direction around shaft 22 as airflow 46 continues to move through gas turbine engine 20.

As airflow 46 continues to move through impeller 24, the curvature of impeller surface 32 causes airflow 46 to change directions from an axial flow to a radial flow. With respect to the illustrated embodiment, by the time that airflow 46 reaches impeller exit 50, it no longer has any significant axial velocity component. Rather, its movement is generally in the radial direction. Additionally, airflow 46 continues to spin (i.e., to have a tangential velocity) due to the spinning of impeller 24.

A portion of airflow 46 (hereinafter "airflow portion 52") does not flow from impeller 24 into conduit 36. Rather, airflow portion 52 flows around a radial tip of impeller 24, through gap 44 and into cavity 42. Once airflow portion 52 enters cavity 42, it moves through cavity 42 and on to the turbine. Airflow portion 52 is used to cool the turbine and other portions of gas turbine engine 20.

Due to the contours of impeller backface 38 and impeller backface shroud 40, as airflow portion 52 moves through cavity 42, it must flow radially inward. However, when airflow portion 52 enters cavity 42, it still has a significant tangential velocity as it did while flowing through impeller 24. Therefore, airflow portion 52 has a tendency to move radially outward under the influence of the centrifugal force acting on airflow portion 52 by its rotation or tangential velocity. This tendency towards radially outward movement is overcome by the pressure differential that exists between the relatively high pressure air leaving impeller 24 and the relatively low pressure air contained within cavity 42. This pressure differential effectively draws the airflow portion 52 in a radially inward direction through cavity 42.

Figure 2B:
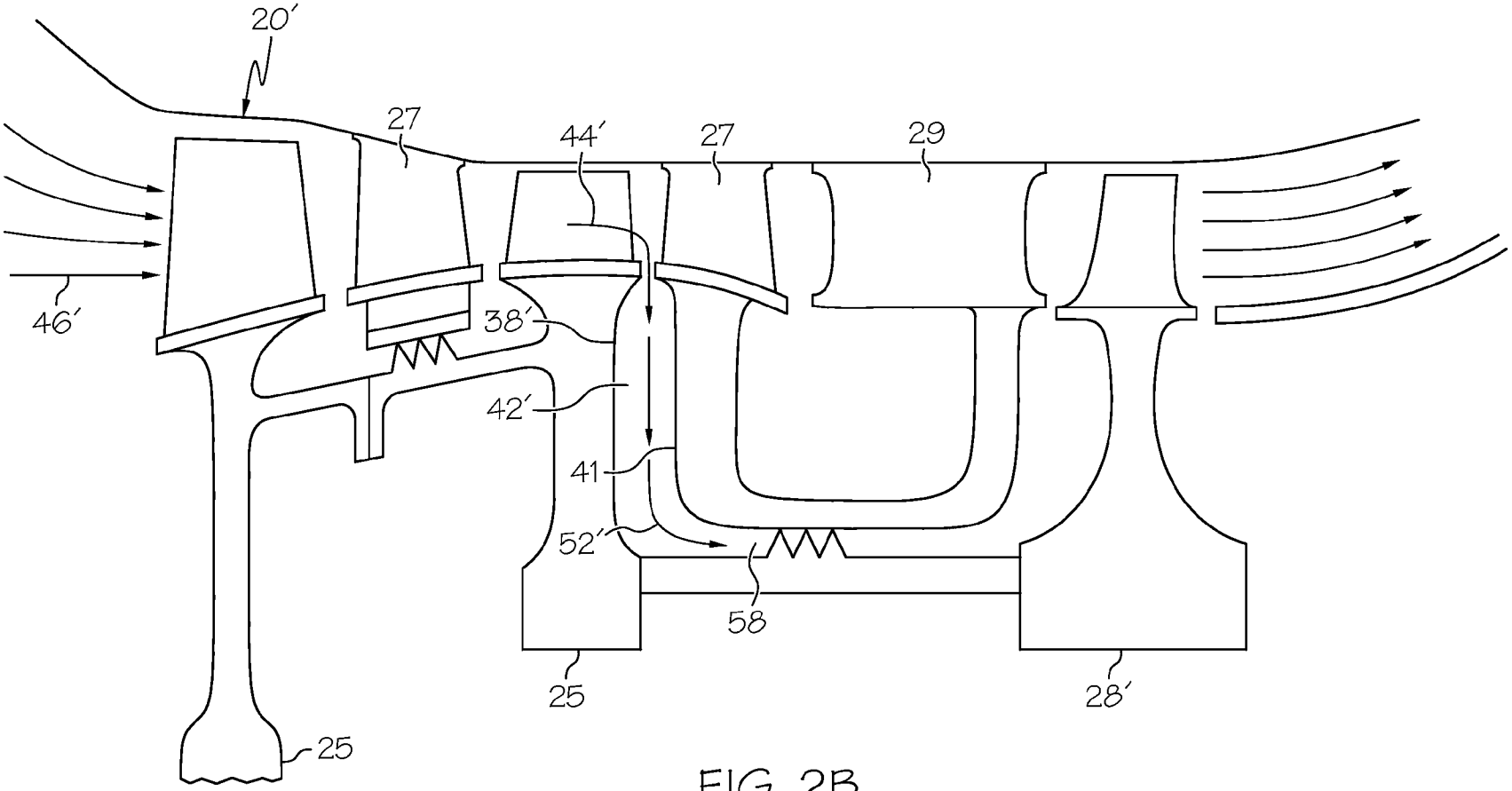
FIG. 2B is a view similar to the view illustrated in FIG. 2A, but of an alternate embodiment of a gas turbine engine.

FIG. 2B is a view similar to the view illustrated in FIG. 2A, but of an alternate embodiment of a gas turbine engine. The embodiment illustrated in FIG. 2B is a gas turbine engine 20' having an axial stage compressor disk including an axial compressor rotor 25, an axial compressor stator 27, a combustor and turbine nozzle assembly 29 (combustor and turbine nozzle assembly details not shown), and a turbine 28'. Airflow 46' moves through gas turbine engine 20'. As airflow 46' passes through axial compressor rotor 25, it is spun and develops a tangential velocity.

A portion of airflow 46' (hereinafter "airflow portion 52'") flows around a radial tip of axial compressor rotor 25, through gap 44' and into a cavity 42' formed by an axial compressor rotor backface 38' and an axial compressor backface shroud 41. Once airflow portion 52' enters cavity 42', it moves through cavity 42', and on to turbine 28'. Airflow portion 52' is used to cool turbine 28' and other portions of gas turbine engine 20'.

Due to the contours of axial compressor backface 38' and impeller backface shroud 41, as airflow portion 52' moves through cavity 42', it must flow radially inward. However, when airflow portion 52' enters cavity 42', it still has a significant tangential velocity as it did while flowing through axial compressor rotor 25. Therefore, airflow portion 52' has a tendency to move radially outward under the influence of the centrifugal force acting on airflow portion 52' by its rotation or tangential velocity. This tendency towards radially outward movement is overcome by the pressure differential that exists between the relatively high pressure air leaving axial compressor rotor 25 and the relatively low pressure air contained within cavity 42'. This pressure differential effectively draws airflow portion 52' in a radially inward direction through cavity 42'.

Figure 3:
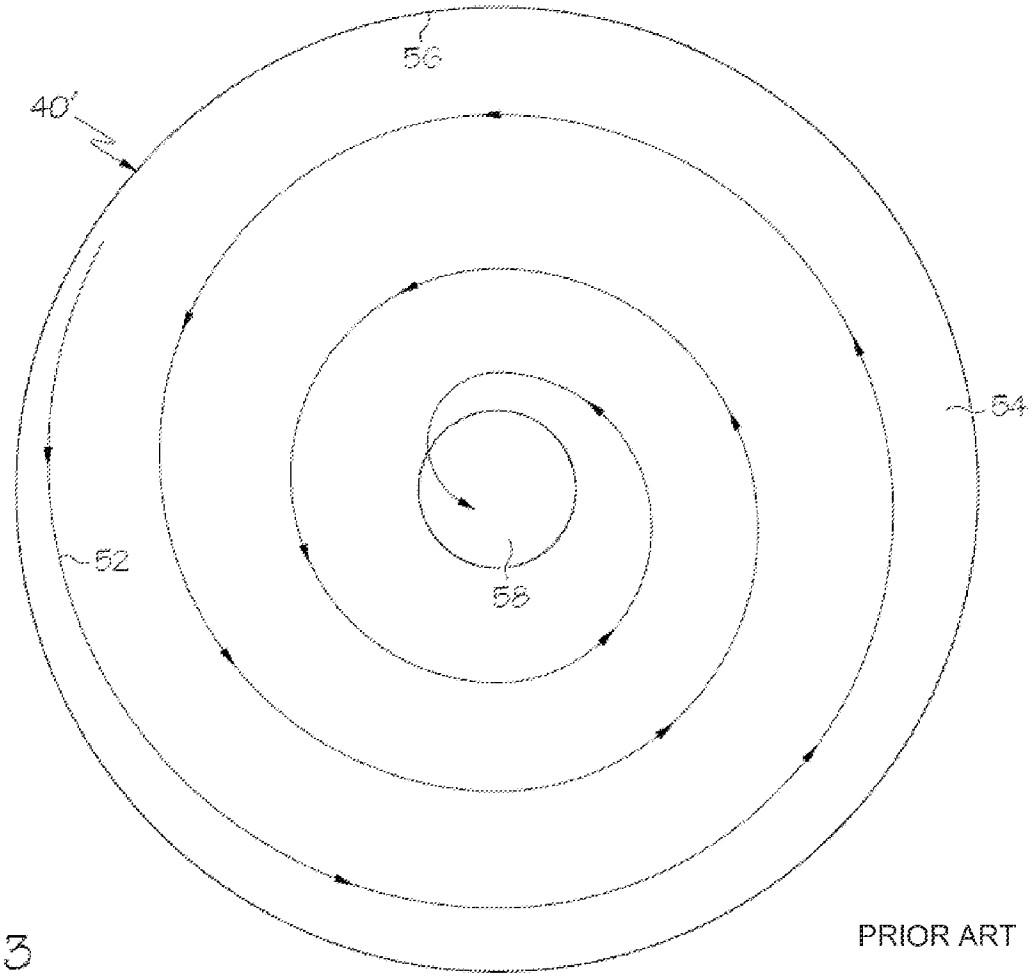
PRIOR ART FIG. 3
FIG. 3 is an axial view of a prior art impeller backface shroud.

FIG. 3 is an axial view of a prior art impeller backface shroud 40'. Prior art impeller backface shroud 40' has smooth surface 54. With continuing reference to FIGS. 2A and B, surface 54 allows airflow portion 52 to flow freely in an uninterrupted manner between a periphery 56 and an exit 58. Because of its tangential velocity, as airflow portion 52 travels radially inward along surface 54 towards exit 58, it forms a vortex. Due to principles of conservation of angular momentum, as the spinning air of airflow portion 52 moves radially inward, it accelerates. Consequently, the air closest to exit 58 is rotating more rapidly than the air closest to periphery 56.

It is a well known principle, based on the Bernoulli equation, that the faster that air flows, the lower its static pressure will be. Conversely, the slower that air flows, the higher its static pressure will be. With continuing reference to FIGS. 2A and B, because airflow portion 52 has a high tangential velocity, the static pressure in cavity 42 and 42' is relatively low as compared with the pressure of airflow 46 pushing on impeller 24 in the direction of cavity 42 and airflow 46' pushing on axial compressor rotor 25 in the direction of cavity 42'. If airflow portion 52 can be slowed, the static pressure in cavity 42 and 42' will increase. If the static pressure in cavity 42/42' increases, it will exert greater pressure on impeller 24 and/or compressor rotor 25 in the forward direction. This greater pressure can be used to offset the spool thrust discussed above in the background section. Therefore, by controlling the speed of airflow portion 52, the undesirable amount of spool thrust can be modified and the risk of thrust bearing failure can be reduced.

With continuing reference to FIG. 3, one way of slowing down airflow portion 52 is to interfere with its flow across surface 54. Such interference can be accomplished by defining a recessed groove in surface 54. A recessed groove will disrupt airflow portion 52 as it flows across surface 54 and will, in turn, reduce the overall speed of airflow portion 52 through cavity 42.

Figure 4:
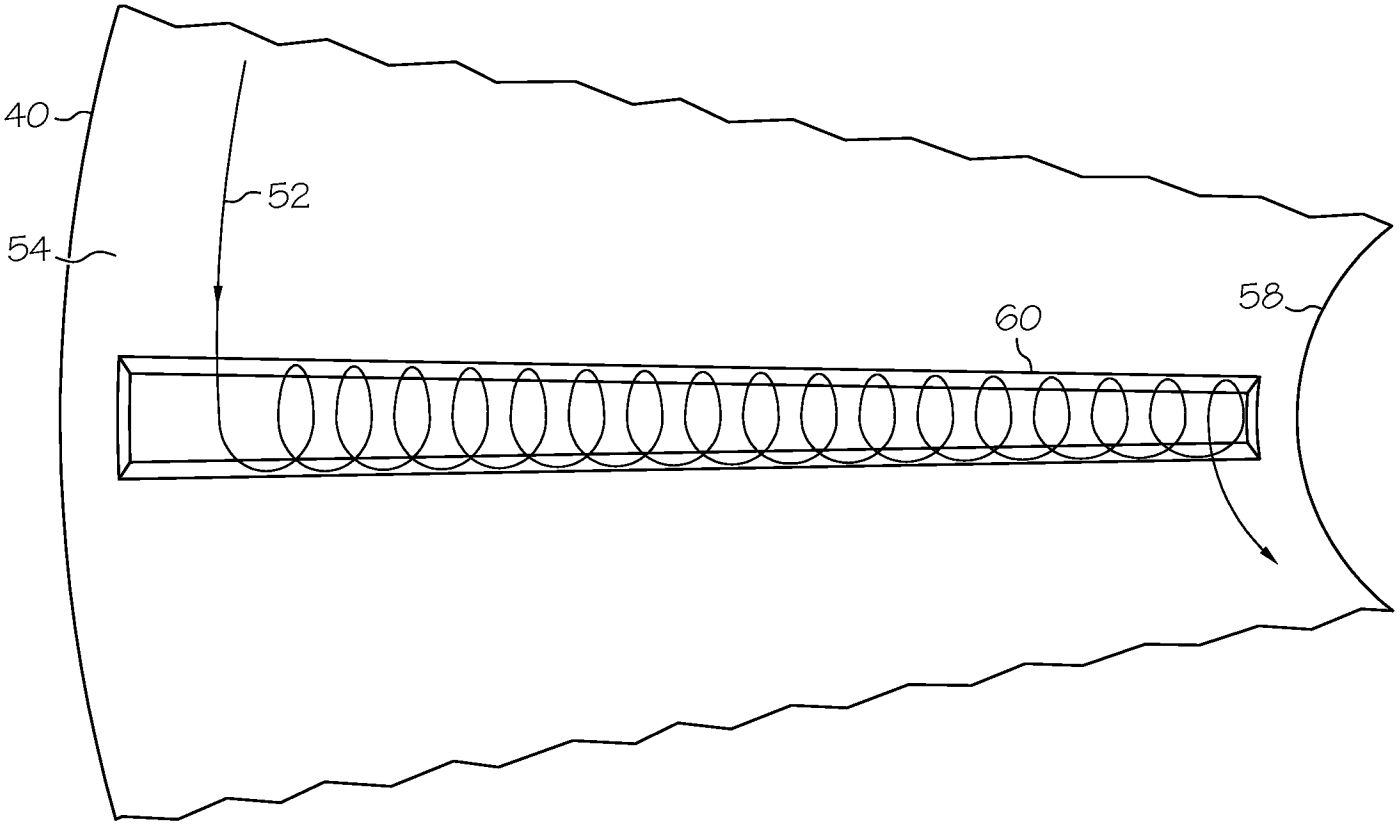
FIG. 4 is an expanded axial view of an impeller backface shroud having a radial recessed groove defined in a surface of the impeller backface shroud.

FIG. 4 is an expanded axial view of impeller backface shroud 40 having a radial recessed groove 60 defined in surface 54. In the illustrated embodiment, radial recessed groove 60 is oriented substantially transversely to the tangential velocity of airflow portion 52. This orientation allows a portion of airflow portion 52 to enter the groove. Once the portion of airflow portion 52 has entered radial recessed groove 60, its tangential movement is obstructed by a forward wall of the groove and will bounce, tumble and swirl generally within the groove towards exit 58. Each such collision with a wall of radial recessed groove 60 and each such change of direction has the effect of slowing down the tangential velocity of airflow portion 52.

Figure 5C:
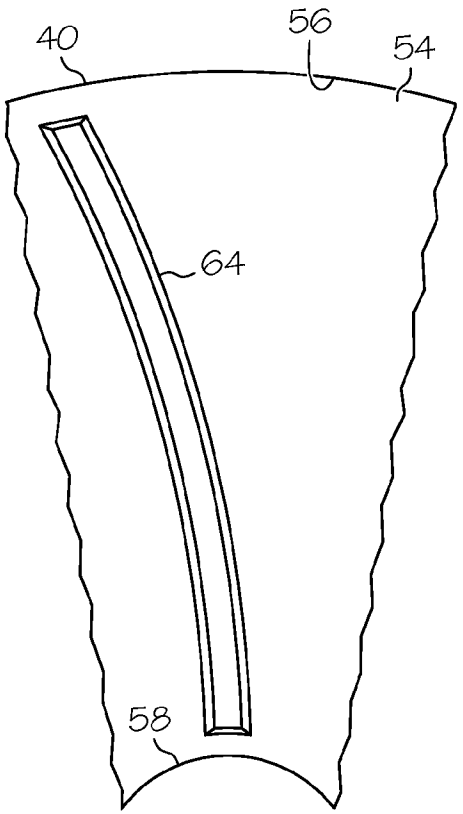
FIGS. 5A-C are axial views of different embodiments of an impeller backface shroud made in accordance with the teachings of the present disclosure, each including a differently configured recessed groove defined in a surface of the impeller backface shroud.
Figure 5B:
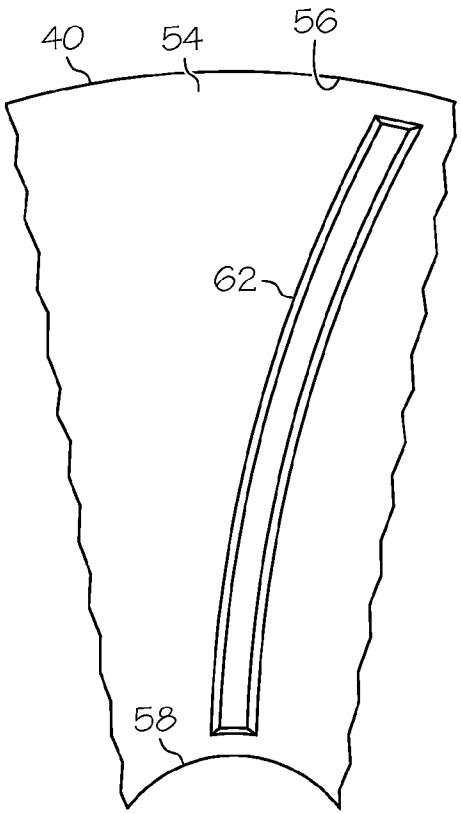
Figure 5A:
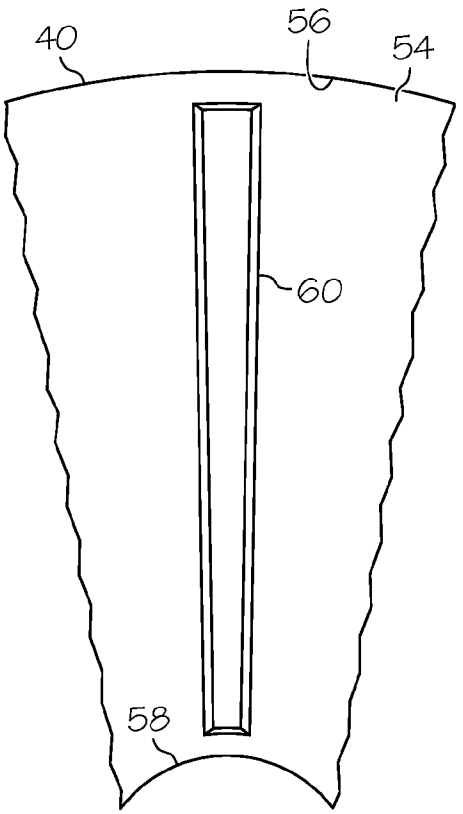

FIG. 5 are axial views of different embodiments of impeller backface shrouds, each including a differently configured recessed groove defined in surface 54. As shown in FIG. 5A, radial recessed groove 60, discussed above with respect to FIG. 4, extends in a straight, radial direction substantially the entire distance from periphery 56 to exit 58. In other embodiments, radial recessed groove 60 may extend for a lesser distance and may have a wider or narrower circumferential width than that illustrated.

With continuing reference to FIGS. 4 and 5, other groove configurations may also be employed. For example, in FIG. 5B, a backward swept groove 62 may be recessed within surface 54 to change the angle at which the groove intercepts airflow portion 52. FIG. 5C illustrates a forward swept groove 64. Variations such as these may have differing impacts on the static pressure within cavity 42 and will allow an engine designer to modulate the static pressure by changing the contours and configuration of the groove. Additionally any suitable number of grooves may be defined in surface 54 and the configuration (radial, forward swept, backward swept) of such grooves may be varied as desired.

Figure 6A:
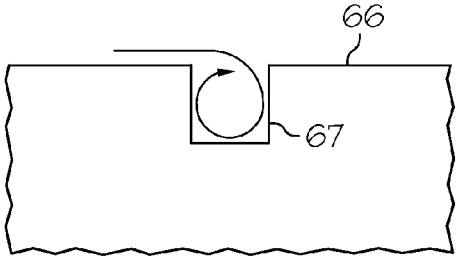
FIGS. 6A-G are a plurality of radial views illustrating different cross sectional configurations for recessed grooves which may be defined in the impeller backface shrouds of FIGS. 5A-C.
Figure 6B:
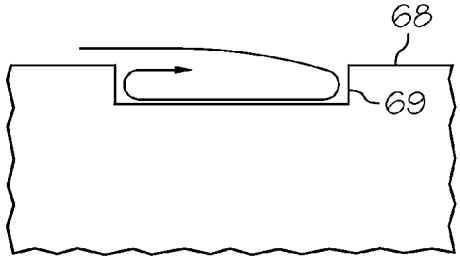
Figure 6C:
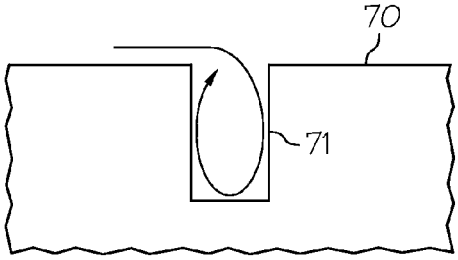
Figure 6D:
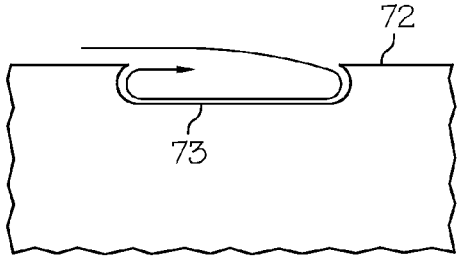
Figure 6E:
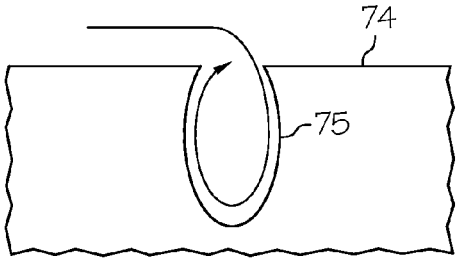
Figure 6F:
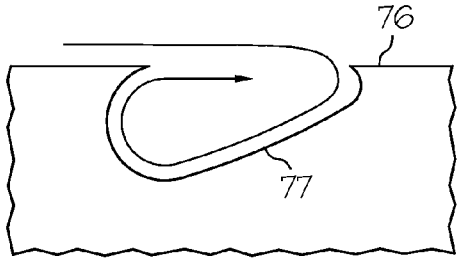
Figure 6G:
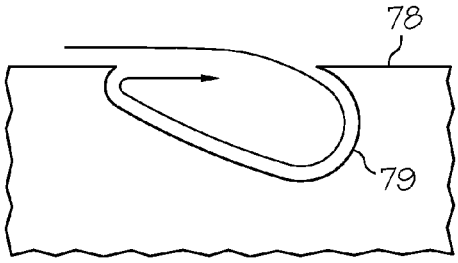

FIG. 6A-G are a plurality of radial views illustrating different cross sectional configurations for recessed grooves which may be defined in the impeller backface shroud of FIGS. 5A-C. As shown in FIG. 6A, impeller backface shroud 66 has a recessed groove 67 having a square aspect-ratio cross section. As shown in FIG. 6B, impeller backface shroud 68 has a recessed groove 69 having a rectangular low-aspect ratio cross section. As shown in FIG. 6C, impeller backface shroud 70 has a recessed groove 71 having a rectangular high aspect-ratio cross section. As shown in FIG. 6D, impeller backface shroud 72 has a recessed groove 73 having a curved low aspect-ratio cross section. As shown in FIG. 6E, impeller backface shroud 74 has a recessed groove 75 having a curved high aspect-ratio cross section. As shown in FIG. 6F, impeller backface shroud 76 has a recessed groove 77 having a cross section with a curved, forward-tapered aspect ratio. As shown in FIG. 6G, impeller backface shroud 78 has a recessed groove 79 that has a cross section having a curved, rearward tapered aspect ratio. Many other geometric configurations and contours are possible. Additionally, in some embodiments, the recessed groove may have a variable depth across either or both the circumferential direction and the radial direction. In still other embodiments, the cross sectional configuration of the groove may vary along a length of the groove.

Each configuration disrupts airflow portion 52 to a different degree, each resulting in a different amount of reduction in the tangential velocity of airflow portion 52 and consequently increasing the static pressure within cavity 42 by a different amount. By varying the geometry of the impeller backface shroud, a designer may adjust the static pressure acting on the spool and thereby reduce or increase the spool thrust to a desired or target level. This capability obviates the need to redesign the thrust bearings. Impeller backface shrouds can be fabricated quickly and inexpensively and doing so would enable a designer to avoid the expense and delay associated with designing and fabricating new thrust bearings.

Although, the present invention describes an impeller backface shroud for use with a gas turbine engine having an impeller, it should be understood that the embodiment may also comprise the compressor disk-shroud spacing behind the last stage of an axial stage compressor disk as well.

Figure 7:
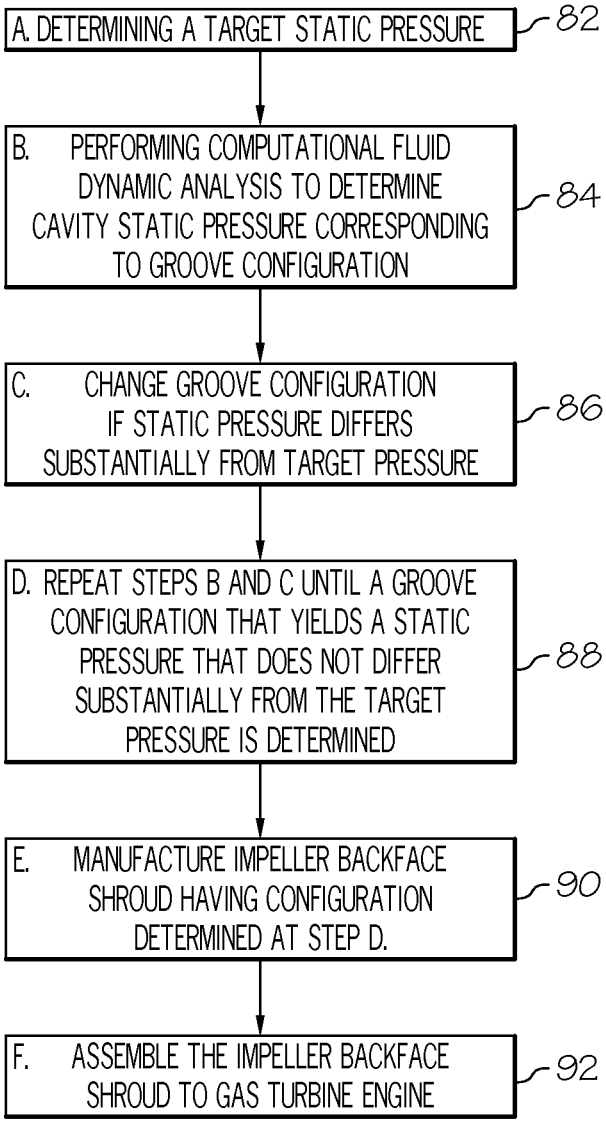
FIG. 7 is a block diagram illustrating an embodiment of a method for compensating for an undesirable amount of spool thrust in a gas turbine engine.

FIG. 7 is a block diagram illustrating an embodiment of a method for compensating for an undesirable amount of spool thrust in a gas turbine engine having an impeller backface shroud. At block 82, a target static pressure is determined. This may be determined by taking into consideration the measured or actual spool thrust detected during a test of a gas turbine engine and comparing that with the thrust tolerance of the thrust bearing. The difference between the two is the amount of differential force that will need to be applied to the spool. Knowing the amount of differential force that is needed to oppose the excessive spool thrust and knowing the surface area of the impeller backface shroud enables a designer to calculate the static pressure that must be present in the cavity to generate a compensating differential force. This calculated static pressure is the target pressure.

At block 84, a computational fluid dynamic analysis, as is commonly employed by those of ordinary skill in the art, is performed to determine what static pressure in the cavity would result if a specific recessed groove configuration were to be employed. Such analysis is commonly performed using a computer running suitable software. One such commercially available software program is ANSYS Fluent. Other programs are also available in the market that could also be used when performing this analysis, such as ANSYS CFX or Numeca Fine/Turbo.

At block 86, the recessed groove configuration is changed if the analysis performed at block 84 does not yield a static pressure in the cavity that is sufficiently close to the target pressure.

At block 88, the steps performed at blocks 84 and 86 are repeated until a static pressure is calculated that is sufficiently close to the target pressure.

At block 90, a second impeller backface shroud having recessed grooves having the configuration determined at block 88 is fabricated.

At block 92, the impeller backface shroud fabricated at block 90 is assembled to the gas turbine engine.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. An impeller or axial stage compressor disk backface shroud for use with a gas turbine engine having an impeller or axial stage compressor disk, the impeller or axial stage compressor disk backface shroud comprising:

a substantially funnel shaped body having a surface, the substantially funnel shaped body configured to be statically mounted to the gas turbine engine in a position that is substantially coaxial with the impeller or axial stage compressor disk, the surface and a backface of the impeller or axial stage compressor disk forming a cavity configured to guide an airflow portion from the impeller to a turbine when the substantially funnel shaped body is mounted to the gas turbine engine coaxially with the impeller or axial stage compressor disk and axially spaced apart therefrom in an aft direction; and a recessed groove defined in the surface, wherein the airflow portion has a tangential velocity and wherein the recessed groove is oriented generally transversely to the tangential velocity of the airflow portion and configured to at least partially interfere with the airflow portion, whereby a static pressure in the cavity is affected, wherein the recessed groove is oriented and configured to reduce an overall speed of the airflow portion through the cavity.

2. The impeller or axial stage compressor disk backface shroud of claim 1, wherein the recessed groove has a cross section having a substantially square aspect ratio.

3. The impeller or axial stage compressor disk backface shroud of claim 1, wherein the recessed groove has a cross section having a rectangular low aspect ratio.

4. The impeller or axial stage compressor disk backface shroud of claim 1, wherein the recessed groove has a cross section having a rectangular high aspect ratio.

5. The impeller or axial stage compressor disk backface shroud of claim 1, wherein the recessed groove has a cross section having a curved low aspect ratio.

6. The impeller or axial stage compressor disk backface shroud of claim 1, wherein the recessed groove has a cross section having a curved high aspect ratio.

7. The impeller or axial stage compressor disk backface shroud of claim 1, wherein the recessed groove has a cross section having a curved forward tapered aspect ratio.

8. The impeller or axial stage compressor disk backface shroud of claim 1, wherein the recessed groove has a cross section having a curved, rearward tapered aspect ratio.

9. The impeller or axial stage compressor disk backface shroud of claim 1, wherein the recessed groove extends radially through the surface.

10. The impeller or axial stage compressor disk backface shroud of claim 1, wherein the recessed groove extends in a forward sweep through the surface.

11. The impeller or axial stage compressor disk backface shroud of claim 1, wherein the recessed groove extends in a rearward sweep through the surface.

12. A gas turbine engine comprising:

a shaft;

an impeller or axial stage compressor disk affixed to the shaft;

a turbine affixed to the shaft at a location aft of the impeller; and an impeller or axial stage compressor disk backface shroud comprising:

a substantially funnel shaped body having a surface, the substantially funnel shaped body being statically mounted to the gas turbine engine in a position that is substantially coaxial with the impeller or axial stage compressor disk and axially spaced apart therefrom in an aft direction such that the surface and a backface of the impeller or axial stage compressor disk form a cavity, the cavity being configured to guide an airflow portion from the impeller or axial stage compressor disk to the turbine, the airflow portion having a tangential velocity; and a recessed groove defined in the surface with first and second closed longitudinal ends, the recessed groove oriented generally transversely to the tangential velocity of the airflow portion and configured to at least partially interfere with the airflow portion, whereby a static pressure in the cavity is increased.

13. The gas turbine engine of claim 12, wherein the recessed groove has a cross section having a substantially square aspect ratio.

14. The gas turbine engine of claim 12, wherein the recessed groove has a cross section having a rectangular low aspect ratio or a rectangular high aspect ratio.

15. The gas turbine engine of claim 12, wherein the recessed groove has a cross section having one of a curved low aspect ratio and a curved high aspect ratio.

16. The gas turbine engine of claim 12, wherein the recessed groove has a cross section having one of a curved, forward tapered aspect ratio and a curved, aft tapered aspect ratio.

17. The gas turbine engine of claim 12, wherein the recessed groove extends in one of a forward sweep through the surface or a rearward sweep through the surface.

18. An impeller or axial stage compressor disk backface shroud for use with a gas turbine engine having an impeller or axial stage compressor disk, the impeller or axial stage compressor disk backface shroud comprising:

a substantially funnel shaped body having a surface, the substantially funnel shaped body configured to be statically mounted to the gas turbine engine in a position that is substantially coaxial with the impeller or axial stage compressor disk, the surface and a backface of the impeller or axial stage compressor disk forming a cavity configured to guide an airflow portion from the impeller to a turbine when the substantially funnel shaped body is mounted to the gas turbine engine coaxially with the impeller or axial stage compressor disk and axially spaced apart therefrom in an aft direction; and a recessed groove defined in the surface, wherein the airflow portion has a tangential velocity and wherein the recessed groove is oriented generally transversely to the tangential velocity of the airflow portion and configured to at least partially interfere with the airflow portion, whereby a static pressure in the cavity is affected, wherein the recessed groove includes first and second closed radial ends.

* * * * *